US007749020B1

(12) United States Patent
Chang

(10) Patent No.: US 7,749,020 B1
(45) Date of Patent: Jul. 6, 2010

(54) POSITIONING AND GROUNDING STRUCTURE FOR RING CONNECTORS

(75) Inventor: Chialu Chang, Taipei (TW)

(73) Assignee: Moxa Inc., Ching Tien (TW)

( * ) Notice: Subject to any disclaimer, the term of this patent is extended or adjusted under 35 U.S.C. 154(b) by 0 days.

(21) Appl. No.: 12/318,064

(22) Filed: Dec. 22, 2008

(51) Int. Cl.
*H01R 13/60* (2006.01)

(52) U.S. Cl. ..... 439/567; 439/63; 439/638

(58) Field of Classification Search ..... 439/567, 439/63, 638
See application file for complete search history.

(56) References Cited

U.S. PATENT DOCUMENTS 5,088,937 A * 2/1992 Gabany ..... 439/581
5,125,470 A * 6/1992 Saunders ..... 180/116
6,164,977 A * 12/2000 Lester ..... 439/63
6,948,977 B1 * 9/2005 Behrent ..... 439/581
7,025,599 B1 * 4/2006 Wang ..... 439/63
7,217,160 B2 * 5/2007 Hsu ..... 439/638
7,464,600 B2 * 12/2008 Kurtz et al. ..... 73/714

* cited by examiner

*Primary Examiner*—Truc T Nguyen
(74) *Attorney, Agent, or Firm*—Bacon & Thomas, PLLC

(57) ABSTRACT

A positioning and grounding structure for ring connectors. A cutting part is formed by cutting one side of the ring connector. The connecting base has a grounding part. Using the relative position between the grounding part and the electrical connecting part as well as the cutting part for double positioning, the ring connector can be quickly fixed on a circuit board. The grounding part can quickly connect noises or electrostatics to the ground. The structure solves the problem of connectors in the prior art that lacks positioning and grounding designs. The provided ring connector can quickly position and ground.

14 Claims, 6 Drawing Sheets

POSITIONING AND GROUNDING STRUCTURE FOR RING CONNECTORS

BACKGROUND OF THE INVENTION

1. Field of Invention

The invention discloses a positioning and grounding structure and, in particular, to a positioning and grounding structure for ring connectors.

2. Related Art

With rapid progress and development in technologies, our life is surrounded with more and more products that involve electrical digital controls instead of conventional mechanical analog controls. The connections between various electronic products or elements rely on different connectors (such as ring connectors). Some commonly seen connectors include ring connectors, specification converting connectors, and so on.

Most connectors consist of a male connector and a female connector. The front end of the female connector is formed with a contact hole. The front end of the male connector has a protruding contact terminal. The size of the contact terminal fits right into the contact hole of the female connector. They are designed for electrical conduction.

Although the above-mentioned structure can achieve the goal of electrical connection, the design does not include positioning. When the female connector needs to be soldered onto a circuit board (most common connecting and fixing method in the prior art), it is impossible to avoid the problem of wrong direction.

In addition, the above-mentioned structure also does not have the grounding design. It is not suitable to use non-insulating materials. When there is some noise or electrostatics in the connector, it stays there. When the user carelessly touches the connector, he/she is likely to be electrically shocked. Obviously, such a design is not industrially safe.

In view of this, it is thus highly desirable to provide both positioning and grounding functions to the connector. When the connector is fixed on a circuit board, it can be quickly positioned. At the same time, any noise or electrostatics can be effectively removed to the ground, preventing the user from being electrically shocked.

In summary, the prior art long has the problems of lacking designs of positioning and grounding for connectors. It is therefore imperative to provide a better design.

SUMMARY OF THE INVENTION

In view of the foregoing, the invention discloses a positioning and grounding structure for ring connectors.

According to the disclosed positioning and grounding structure for ring connectors, the ring connector includes a connecting base, a connecting part, a fixing part, and an electrical connecting part. The first surface of the connecting base has the connecting part, around which is disposed with the fixing part. The electrical connecting part is disposed on the second surface thereof and electrically connected with the connecting part. A first embodiment of the disclosed positioning and grounding structure for ring connectors is featured in that: one side of the fixing part is cut to form a cutting part. Moreover, the second surface of the connecting base is disposed with a grounding part for grounding. Using the relative position between the grounding part and the electrical connecting part as well as the cutting part, the invention achieves double positioning. The ring connector can quickly and correctly fixed on a circuit board.

According to the disclosed positioning and grounding structure for ring connectors, the ring connector includes a connecting base, a connecting part, a fixing part, and an electrical connecting part. The first surface of the connecting base has the connecting part, around which is disposed with the fixing part. The electrical connecting part is disposed on the second surface thereof and electrically connected with the connecting part. A second embodiment of the disclosed positioning and grounding structure for ring connectors is featured in that: a cutting part is formed by cutting one side of the fixing part. The first surface of the connecting base is extended with at least one grounding board whose end is disposed with the grounding part for grounding. The relative position between the grounding part and the electrical connecting part as well as the cutting part achieve double positioning. This enables the ring connector to be quickly and correctly fixed on a circuit board.

The disclosed system and method have been described above. They differ from the prior art in that one side of the connecting part is cut to form a cutting part and that the connecting base is disposed with a grounding part. Using the relative position between the grounding part and the electrical connecting part as well as the cutting part for double positioning, the ring connector can be quickly fixed on a circuit board. The grounding part can connect noises or electrostatics to the ground, preventing the user from being electrically shocked.

Using the disclosed technique, the invention achieves the effect of quickly positioning and grounding the ring connector.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2:
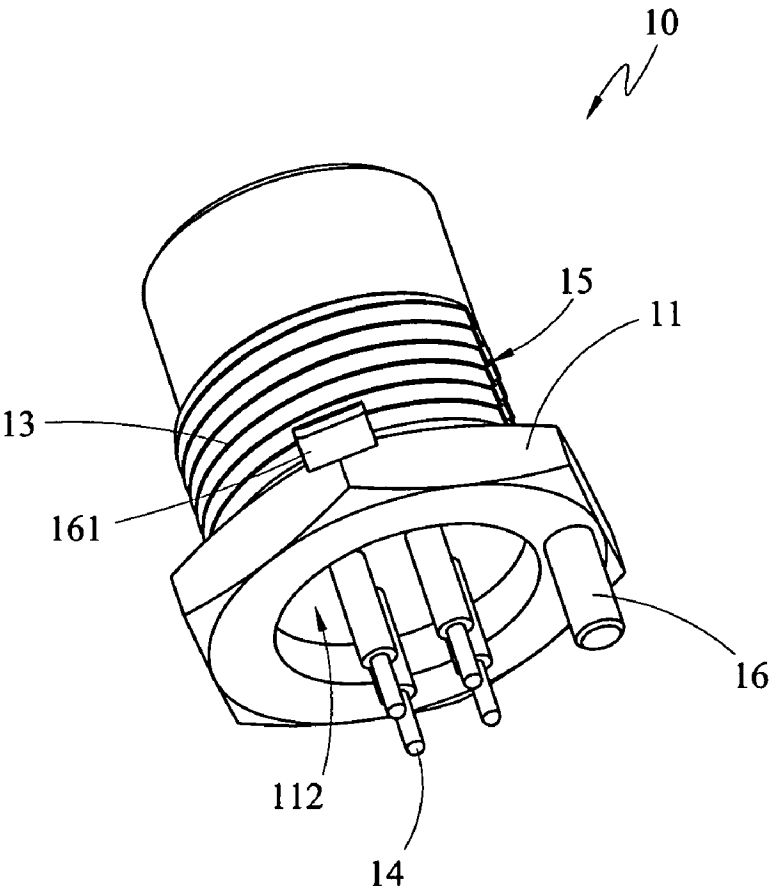
FIG. 2 is a three-dimensional view of the first embodiment of the disclosed positioning and grounding structure for ring connectors from a second perspective.
Figure 1:
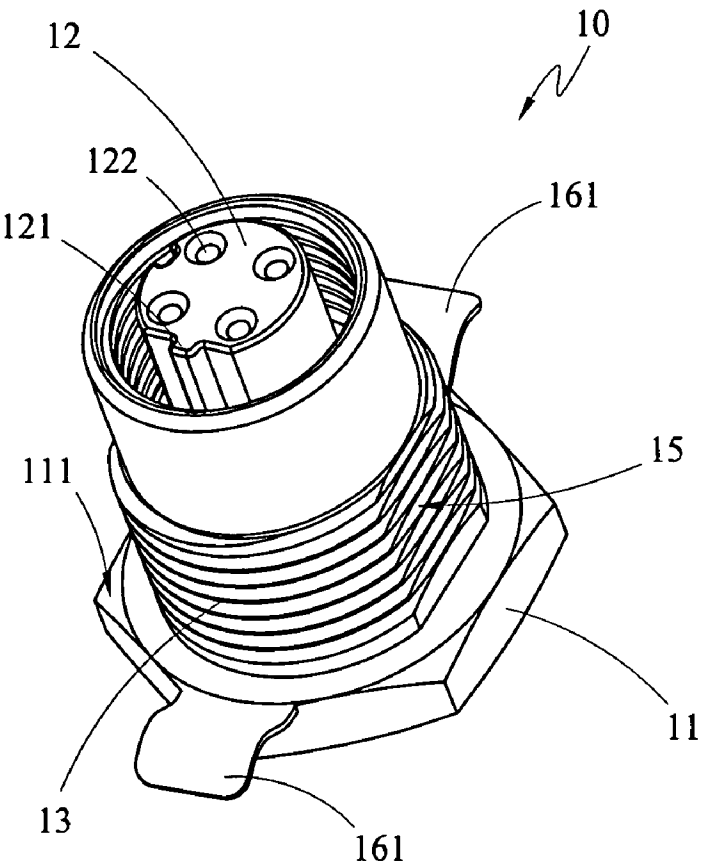
FIG. 1 is a three-dimensional view of the first embodiment of the disclosed positioning and grounding structure for ring connectors from a first perspective.

A first embodiment of the disclosed positioning and grounding structure for ring connectors is depicted in FIGS. 1 and 2. FIG. 1 is a three-dimensional view of the first embodiment from a first perspective. FIG. 2 is a three-dimensional view of the first embodiment from a second perspective.

As shown in FIGS. 1 and 2, the ring connector 10 includes a connecting base 11, a connecting part 12, a fixing part 13, an electrical connecting part 14, a cutting part 15, and a grounding part 16.

The connecting base 11 has a first surface 111 and a second surface 112. The first surface 111 of the connecting base 11 is disposed with a connecting part 12. The connecting part 12 is electrically connected with the corresponding connector thereof.

The shape of the connecting part 12 and the shape of the corresponding connector thereof have to match each other. The connecting part 12 can be provided with a positioning part 121. When the connecting part 12 is connected with the corresponding connector thereof, the positioning part 121 enables the signal connector to correctly insert into the signal hole 122 of the connecting part 12. Therefore, there is no problem in signal transmissions between the connecting part 12 and the corresponding connector thereof.

The connecting part 12 is surrounded by the fixing part 13. The fixing part 13 is used to fix the corresponding connector of the connecting part 12. It prevents the connector from being pulled out of the connecting part 12 due to some external force, resulting in incorrect signal transmissions.

The second surface 112 of the connecting base 11 is disposed with an electrical connecting part 14. One end of the electrical connecting part 14 exposes from the second surface 112 of the connecting base 11 for electrical connection with a circuit board (not shown). The other end of the electrical connecting part 14 is embedded inside the connecting base 11, forming an electrical connection with the connecting part 12. Through the electrical connection between the connecting part 12 and the electrical connecting part 14, the corresponding connector of the connecting part 12 can transmit an external signal into the circuit board for control or read signals from the circuit board.

Afterwards, one side of the fixing part 13 is cut to form a cutting part 15. Such a cut can be formed by laser or a traditional milling machine. When the electrical connecting part 14 and the circuit board establish an electrical connection by soldering, one can clearly see whether the positioning between the electrical connecting part 14 and the circuit board is correct from the cutting part 15. This avoids incorrect positioning from resulting in errors in signal transmission. It further prevents incorrect soldering from affecting the production quality and yield.

Besides, the second surface 112 of the connecting base 11 is also disposed with the grounding part 16 in direct connection with the connecting base 11. When the electrical connecting part 14 and the grounding part 16 form electrical connections with the circuit board by soldering, the relative position of the grounding part 16 and the electrical connecting part 14 controls positioning between the electrical connecting part 14 and the circuit board. This avoids incorrect positioning from resulting in errors in signal transmission, as well as prevents incorrect soldering from affecting the production quality and yield.

The above-mentioned machining method is only an example. The invention is not limited to this method. Any machining method that can form the cutting part 15 and any method that can form electrical connection between the electrical connecting part 14 and the circuit board should be included in the scope of the invention.

Besides, the grounding part 16 can conduct noises or electrostatics produced in the connecting base 11, the connecting part 12, and the fixing part 13 to the grounding portion of the circuit board. This prevents the noises or electrostatics from interfering the signal transmissions of the ring connector 10 and satisfies industrial safety requirements.

Furthermore, the first surface 111 of the connecting base 11 can be extended with an elastic plate 161. The outer diameter of the connecting base 11 is greater than that of the connecting part 12. When assembling the ring connector 10 and a housing (not shown), the larger outer diameter of the connecting base 11 attaches the elastic plate 161 extended from the first surface 111 of the connecting base 11 to the inner surface of the housing. Using this method, the noises or electrostatics produced by the housing can be transferred to the grounding portion of the circuit board through the elastic plate 161, preventing the noises or electrostatics from interfering with the signal transmissions of the ring connector 10 and satisfying the industrial safety requirements.

Figure 7:
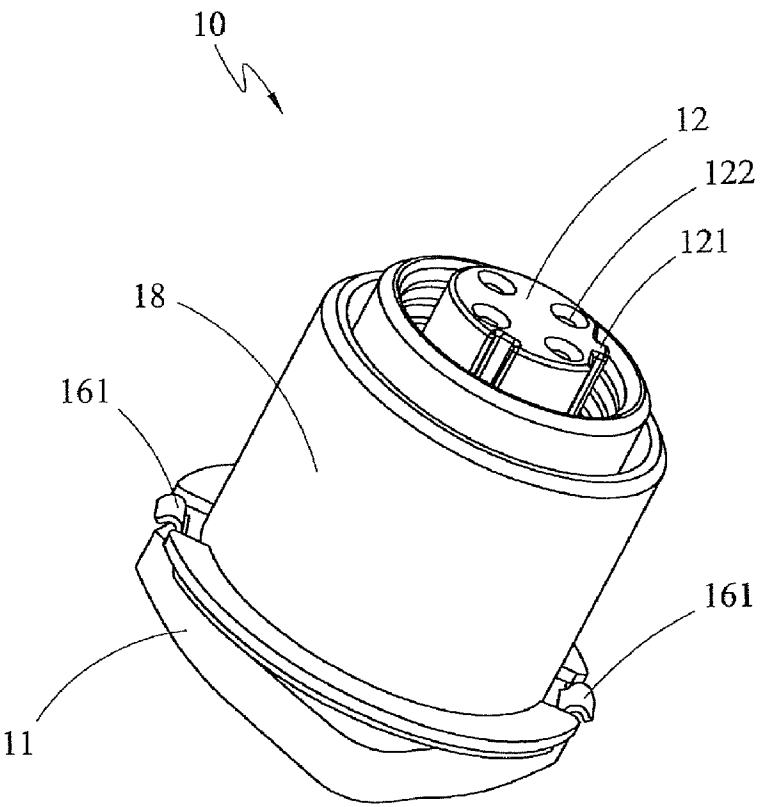
FIG. 7 is a three-dimensional view of the insulating housing of first embodiment of the disclosed positioning and grounding structure for ring connectors from a first perspective.

The ring connector 10 can further use an insulating housing 18, as shown in FIG. 7, to cover the exterior of the connecting base 11, the connecting part 12, and the fixing part 13. The elastic plate 161 extended from the first surface 111 of the connecting base 11 penetrates out of the insulating housing. The electrical connecting part 14 also penetrates out of the insulating housing. In addition of insulation protection for the ring connector 10, noises or electrostatics produced on the housing can be transferred to the grounding portion of the circuit board via the elastic plate 161. This prevents the noises or electrostatics from interfering with the signal transmissions of the ring connector 10 and satisfies the industrial safety requirements.

Figure 4:
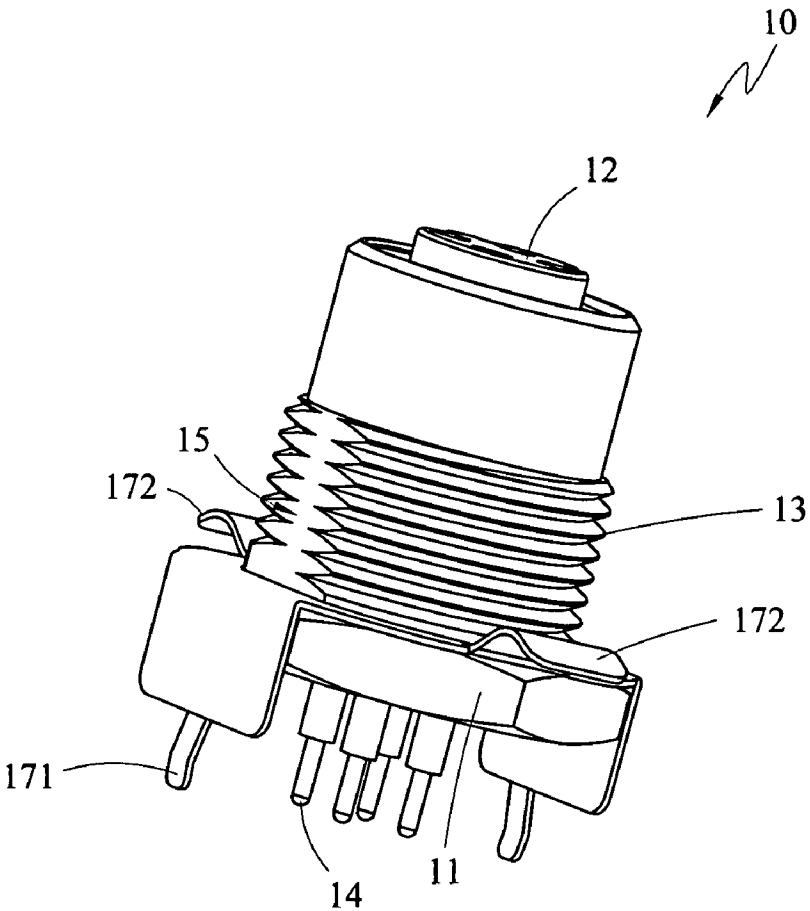
FIG. 4 is a three-dimensional view of the second embodiment of the disclosed positioning and grounding structure for ring connectors from a second perspective.
Figure 3:
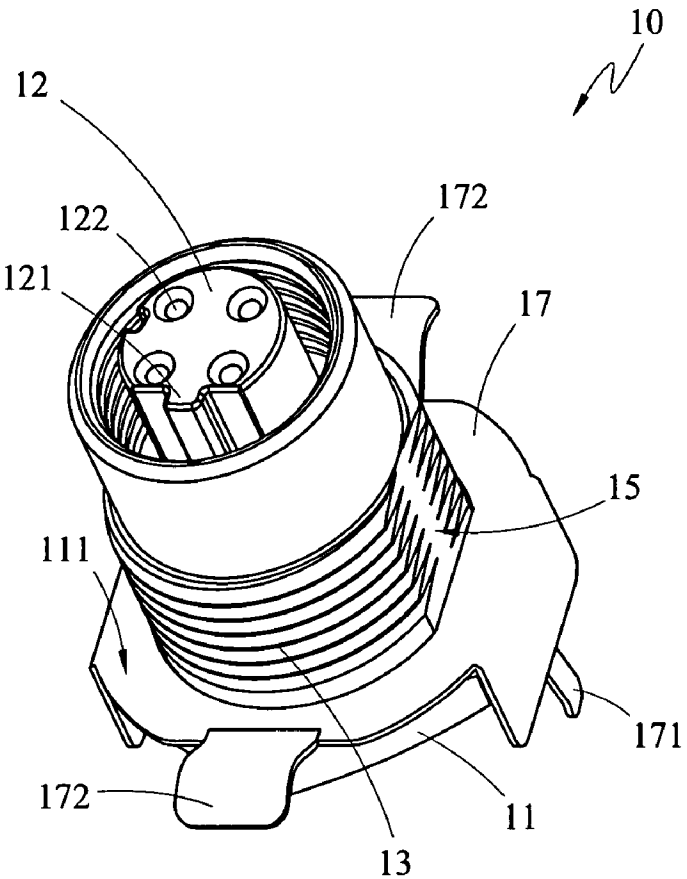
FIG. 3 is a three-dimensional view of the second embodiment of the disclosed positioning and grounding structure for ring connectors from a first perspective.

The following describes a second embodiment of the disclosed positioning and grounding structure for ring connectors. Please refer to FIG. 3 and FIG. 4. FIG. 3 is a three-dimensional view of the second embodiment of the invention from a first perspective. FIG. 4 is a three-dimensional view of the second embodiment of the invention from a second perspective.

Parts of the second embodiment that are the same as the first embodiment will not be further described herein. Only those parts that are different are explained below.

The second embodiment and the first embodiment differ in the grounding part. The grounding part 16 of the first embodiment is disposed on the second surface 112 of the connecting base 11. In the second embodiment, the first surface 111 of the connecting base 11 is extended with at least one grounding board 17. The grounding board 17 is bent toward the second surface 112 of the connecting base 11. The end of the bent part of the grounding board 17 is disposed with a grounding part 171. Using this method, the grounding part 171 establishes electrical connection with the circuit board by soldering (only as an example, not to restrict the scope of the invention). The relative position between the cutting part 15 and the grounding part 171 enables positioning of the electrical connecting part 14 on the circuit board. This prevents the noises or electrostatics from interfering with the signal transmissions and affecting the quality and yield of the products.

Besides, both sides of the unbent part of the grounding board 17 are extended with elastic plates 172. The outer diameter of the connecting base 11 is larger than the outer diameter of the connecting part 12. When assembling ring connector 10 and the housing (not shown), the larger outer diameter of the connecting base 11 attaches the elastic plates 172 extended from both sides of the unbent part of the grounding board 17 to the inner surface of the housing. Using this method, noises or electrostatics produced by the housing can be transferred to the grounding portion of the circuit board via the elastic plates 172. This prevents the noises or electrostatics from interfering with the signal transmissions of the ring connector 10 and satisfies the industrial safety requirements.

Figure 8:
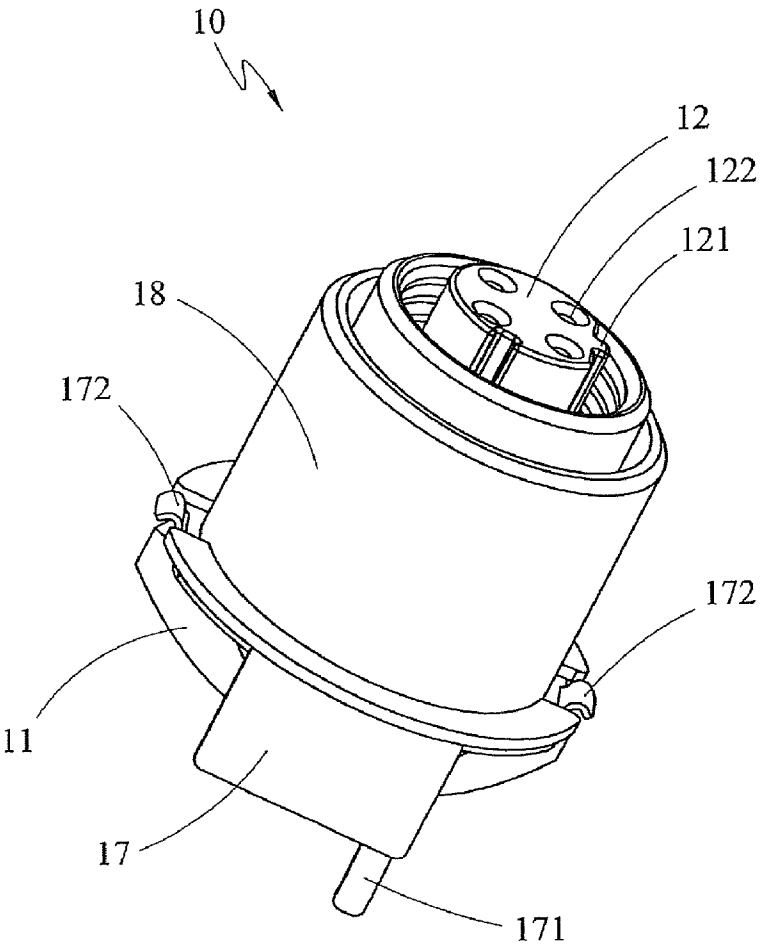
FIG. 8 is a three-dimensional view of the insulating housing of second embodiment of the disclosed positioning and grounding structure for ring connectors from a first perspective.

The ring connector 10 covers the exteriors of the connecting base 11, the connecting part 12, the fixing part 13, and the grounding board 17 through its insulating housing 18, as shown in FIG. 8. Both sides of the unbent part of the grounding board 17 are extended with elastic plates 172 penetrating out of the insulating housing. The electrical connecting part 14 also penetrates out of the insulating housing. In addition to insulation protection of the ring connector 10, noises or electrostatics produced by the housing can be transferred to the grounding portion of the circuit board via the elastic plates 172. This prevents the noises or electrostatics from interfering with the signal transmissions of the ring connector 10 and satisfies the industrial safety requirements.

Figure 5A:
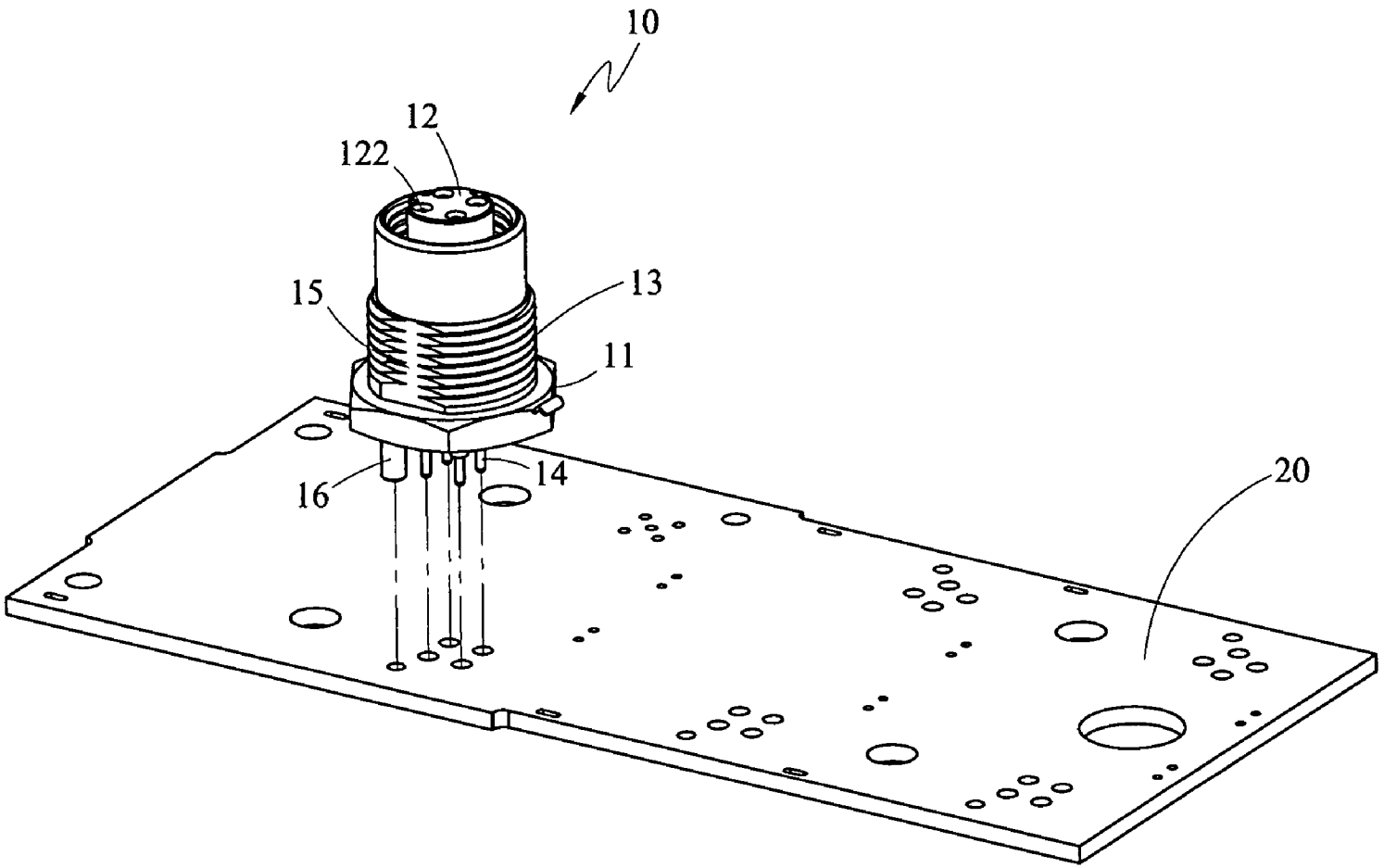
FIG. 5A is a three-dimensional exploded view of the disclosed ring connector and circuit board.
Figure 5B:
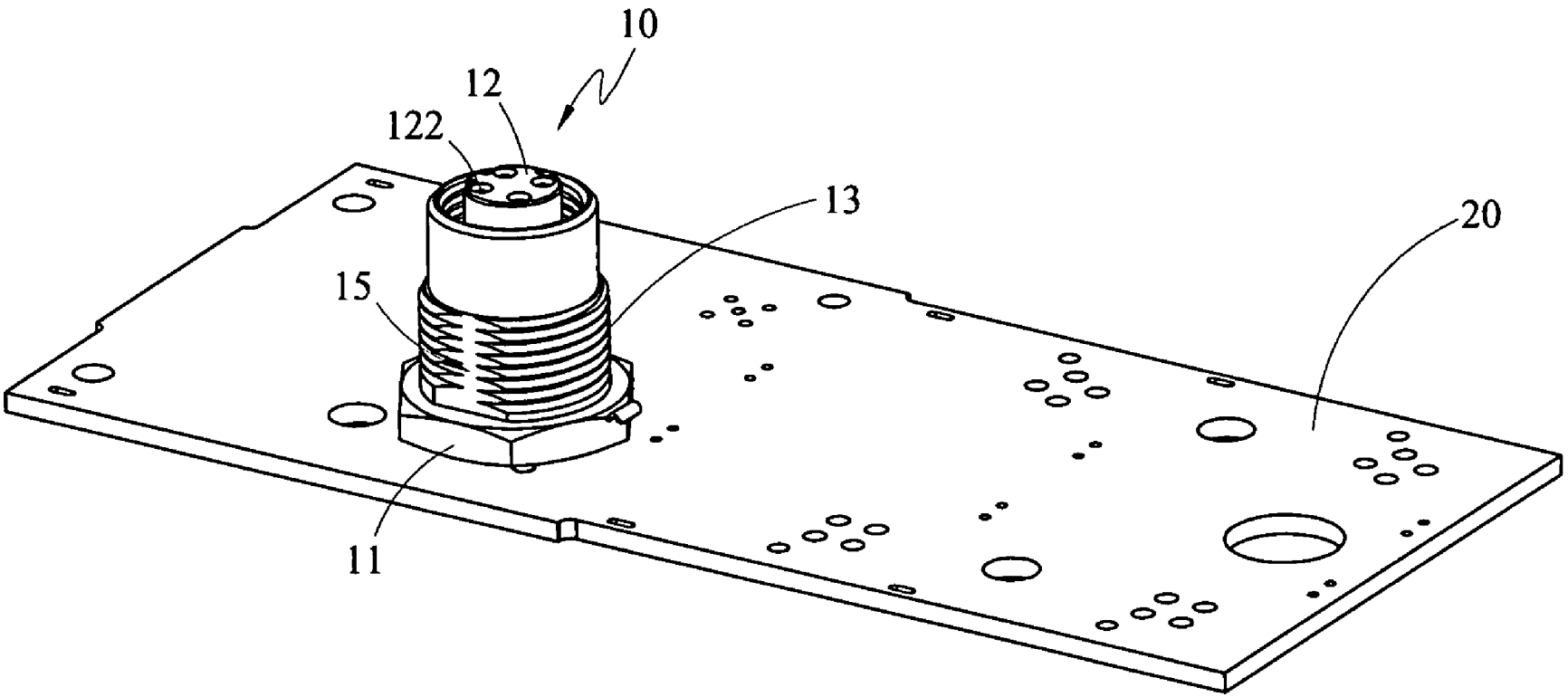
FIG. 5B is a three-dimensional assembly view of the disclosed ring connector and circuit board.
Figure 6:
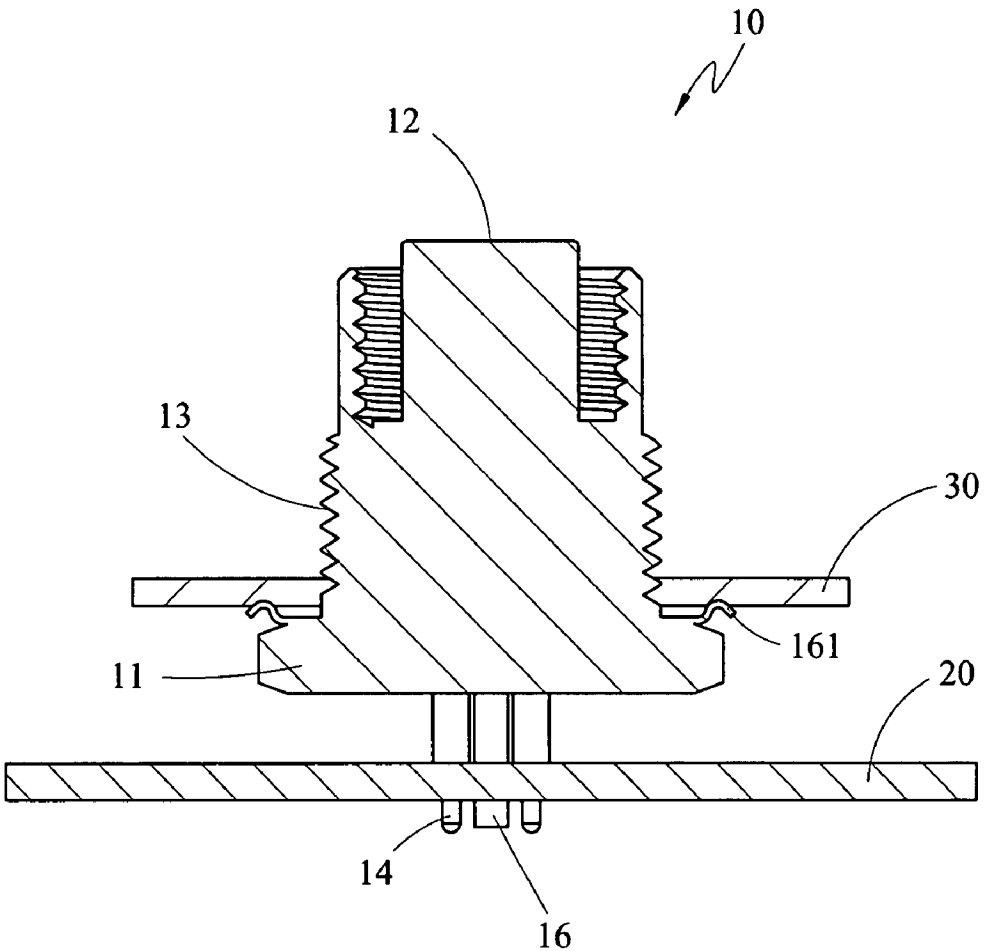
FIG. 6 is a cross-sectional view of the disclosed ring connector and circuit board installed in the housing.

For people skilled in the art to understand the invention better, a first embodiment along with FIGS. 5A, 5B, and 6 are used to illustrate an application of the invention. FIG. 5A is a three-dimensional exploded view of the disclosed ring connector and circuit board. FIG. 5B is a three-dimensional assembly view of the disclosed ring connector and circuit board. FIG. 6 is a cross-sectional view of the disclosed ring connector and circuit board installed in the housing.

Please first refer to FIG. 5A. The electrical connecting part 14 and the grounding part in the ring connector 10 are fixed on a circuit board 20 by soldering (only an example, not to restrict the scope of the invention). The relative position of the electrical connecting part 14 and the grounding part 16 and the cutting part 15 position the ring connector 10 on the circuit board 20. The soldered result is shown in FIG. 5B.

The grounding part 16 can transfer noises or electrostatics produced by the connecting base 11, the connecting part 12, and the fixing part 13 to the grounding portion of the circuit board 20. This prevents the noises or electrostatics from interfering with the signal transmissions of the ring connector 10 and satisfies the industrial safety requirements.

Please refer to FIG. 6. The housing 30 is formed with a hole corresponding to the ring connector. The ring connector 10 is inserted into the hole. The ring connector 10 is fixed on the inner surface of the housing 30 by screw fastening. In this case, the elastic plate 161 extended from the first surface 111 of the connecting base 11 is attached on the inner surface of the housing 30. Using this method, noises or electrostatics produced by the housing can be transferred to the grounding portion of the circuit board via the elastic plate 161. This prevents the noises or electrostatics from interfering with the signal transmissions of the ring connector 10 and satisfies the industrial safety requirements.

The fixing method of the ring connector 10 and the housing 30 is screw fastening. This is only an example, and should not be used to restrict the scope of the invention. Any method of fixing the ring connector 10 on the housing 30 (e.g., locking or buckling) should be included in the scope of the invention.

After inserting the ring connector 10 into the hole of the housing 30 and fixing the ring connector 10 on the inner surface of the housing 30, the user can correctly insert the signal connector (not shown) corresponding to the connecting part 12 into a signal connecting hole 122 of the connecting part 12. The connector corresponding to the connecting part 12 is fixed on the connecting part 12, surrounded by the fixing part 13. This prevents the connector from departing from or being pulled out of the connecting part 12 due to some external force. This avoids incorrect signal transmissions during use. Through the electrical connection between the connecting part 12 and the electrical connecting part 14, external signals are transmitted to the circuit board 20 for controls. Alternatively, signals can be read from the circuit board 20 as well.

In summary, the invention differs from the prior art in that one side of the connecting part in the ring connector is cut to form a cutting part. The connecting base is disposed with a grounding part. Using the double positioning of the relative position between the grounding part and the electrical connecting part and the cutting part, the ring connector can be quickly fixed on the circuit board. Through the grounding part, noises or electrostatics can be effectively transferred to the grounding.

The disclosed technique can solve the problems of lacking the designs of positioning and grounding in the prior art. As a result, the ring connector can be quickly fixed and grounded.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A positioning and grounding structure for a ring connector, comprising:

a connecting base, a connecting part, a fixing part, and an electrical connecting part, with the connecting part being disposed on a first surface of the connecting base, the fixing part surrounding the connecting part, the electrical connecting part being disposed on a second surface of the connecting base in electrical connection with the connecting part, wherein one side of the fixing part is cut to form a cutting part, a grounding part is disposed on the second surface of the connecting base for grounding, an elastic plate is extended on the first surface of the connecting base, and the relative position of the grounding part and the electrical connecting part along with the cutting part achieves the function of double positioning so that the ring connector is quickly and correctly fixed on the circuit board.

2. The positioning and grounding structure for a ring connector of claim 1, wherein the outer diameter of the connecting base is greater than the outer diameter of the connecting part.

3. The positioning and grounding structure for a ring connector of claim 1, wherein the connecting part further includes a positioning part.

4. The positioning and grounding structure for a ring connector of claim 1, wherein one end of the electrical connecting part exposes from the second surface of the connecting base and its other end is embedded inside the connecting part to form an electrical connection with the connecting part.

5. The positioning and grounding structure for a ring connector of claim 1, wherein the ring connector further includes an insulating housing to cover the connecting base, the connecting part, and the fixing part.

6. The positioning and grounding structure for a ring connector of claim 5, wherein the elastic plate penetrates out of the insulating housing.

7. The positioning and grounding structure for a ring connector of claim 5, wherein the grounding part penetrates out of the insulating housing.

8. A positioning and grounding structure for a ring connector, comprising:

a connecting base, a connecting part, a fixing part, and an electrical connecting part, with the connecting part being disposed on a first surface of the connecting base, the fixing part surrounding the connecting, the electrical connecting part being disposed on a second surface of the connecting base in electrical connection with the connecting part, wherein one side of the fixing part is cut to form a cutting part, at least one grounding board is extended from the first surface and a grounding part is disposed at the end of the grounding board for grounding, an elastic plate is extended from the at least one grounding board, and the relative position of the grounding part and the electrical connecting part along with the cutting part achieves the function of double positioning so that the ring connector is quickly and correctly fixed on the circuit board.

9. The positioning and grounding structure for a ring connector of claim 8, wherein the outer diameter of the connecting base is greater than the outer diameter of the connecting part.

10. The positioning and grounding structure for a ring connector of claim 8, wherein the connecting part further includes a positioning part.

11. The positioning and grounding structure for a ring connector of claim 8, wherein one end of the electrical connecting part exposes from the second surface of the connecting base and its other end is embedded inside the connecting part to form an electrical connection with the connecting part.

12. The positioning and grounding structure for a ring connector of claim 8, wherein the ring connector further includes an insulating housing to cover the connecting base, the connecting part, and the fixing part.

13. The positioning and grounding structure for a ring connector of claim 12, wherein the elastic plate penetrates out of the insulating housing.

14. The positioning and grounding structure for a ring connector of claim 12, wherein the grounding part penetrates out of the insulating housing.

* * * * *